US005084138A

United States Patent [19]

Ewald

[11] Patent Number: 5,084,138

[45] Date of Patent: Jan. 28, 1992

[54] DEFLECTION COMPENSATED FORMING WIRE TURNING BAR

[75] Inventor: James L. Ewald, Roscoe, Ill.

[73] Assignee: Beloit Corporation, Beloit, Wis.

[21] Appl. No.: 611,630

[22] Filed: Nov. 13, 1990

[51] Int. Cl.[5] ..... D21F 1/36

[52] U.S. Cl. ..... 162/300; 162/252; 162/301; 162/352

[58] Field of Search ..... 162/203, 202, 300, 301, 162/352, 354, 252

[56] References Cited

U.S. PATENT DOCUMENTS

| | | | |
|---|---|---|---|
| 3,440,136 | 4/1969 | Nelson et al. | 162/203 |
| 3,585,105 | 6/1971 | Stuebe | 162/352 |
| 3,746,613 | 7/1973 | Vauhkonen | 162/301 |
| 4,124,441 | 11/1978 | Nykopp | 162/301 |
| 4,609,435 | 9/1986 | Tissari | 162/352 |
| 4,724,047 | 2/1988 | Creagan et al. | 162/301 |
| 4,769,111 | 9/1988 | Nevalainen et al. | 162/301 |

*Primary Examiner*—Karen M. Hastings

*Attorney, Agent, or Firm*—Dirk J. Veneman; Raymond W. Campbell; Gerald A. Mathews

[57] ABSTRACT

A mechanism and method for initially dewatering a paper stock slurry between looped traveling forming wires wherein the wires pass over turning bars, controlling the cross machine curvature of the turning bars to compensate for variations in curvature due to temperature effects on the turning bar and to control the cross machine curvature of the turning bar to a predetermined fixed shape for wide machines to control the travel of the wire over the bars by applying bending moments to a support beam for the turning bar such as by providing separate liquid chambers in the beam and directing heated or cooled water into the chambers to bend the bar to either a positive crown, to be straight or to a negative crown.

7 Claims, 2 Drawing Sheets

DEFLECTION COMPENSATED FORMING WIRE TURNING BAR

BACKGROUND OF THE INVENTION

The present invention relates to improvements in papermaking machines, and more specifically to a twin wire former where the wires are guided into the forming throat by turning bars and the cross machine curvature of the turning bars is controlled.

A typical paper web forming section includes a headbox for ejecting paper stock onto a moving flat screen known as a fourdrinier wire. The stock from the headbox impinges against the moving fourdrinier wire and water within the stock is drained downwardly through the wire so that a fibrous web is formed on the upper surface of the fourdrinier wire.

However, due to the downward drainage of water from the web, the resultant web has an upper surface which displays different surface characteristics from the lower surface of the web. Such two-sidedness, or lack of uniformity between the upper and lower surfaces of the web, has caused problems in the finished product when used for printing in which uniformity of the surfaces is desirable.

Accordingly, forming machines were developed which enabled the web to be dewatered upwardly as well as downwardly. These so-called "twin-wire" machines include an upper wire loop which cooperates with the lower fourdrinier wire such that the stock entering a forming section defined by the upper and lower wires is typically subjected to vacuum applied through the upper wire for removing a further portion of water from the web upwardly through the second wire.

The twin-wire concept was modified by moving the headbox to adjacent a first end of the forming section defined by the cooperating twin wires. The resultant forming section is known as the "BEL BAIE FORMER". BEL BAIE is a registered trademark of Beloit Corporation. The BEL BAIE forming section includes a pair of breast rolls for guiding the respective wires so that the wires cooperate together to define the aforementioned forming section. However, of necessity, the rotating breast rolls are of a diameter such that it is difficult to position the slice lip of the headbox very close to the first end of the forming section.

Experiments have indicated that when the slice lip of the headbox is moved nearer to the first end of the forming section, less disturbance and breaking up of the stock occurs between the headbox and the first end and the uniformity of the resultant web is improved. Furthermore, less streaking occurs when the slice lip is brought up very close to the first end as the angle at which the stock impinges, or first contacts the lower wire is minimized.

An important development in the advance of dewatering by twin wire machines includes reducing the distance between the headbox and the first end of the forming section by using stationary turning bars in place of rotatable breast rolls. In order to accurately guide the path of the forming wires as they enter the throat, the turning bars must be accurately positioned and this is particularly true for very wide machines. Temperature differences due to friction on the turning bars and due to the temperature of the stock and ambient factors frequently affect the curvature of the turning bars so that the travel of the wire over the bars is varied thus causing turbulence in the stock and unequal initial dewatering. In some cases it may be desirable for the turning bars to remain absolutely straight across the width of the machine, or in other cases the turning bars may be positioned so that they are formed with a slight crown for insuring the spread of the wire as it enters the throat. Also, because of other effects on the turning bars, it may be desired to apply a force of the turning bars to cause an effective force which tends to cause a negative crown on the bars. In any event in addition to the other attendant advantages of using turning bars instead of breast rolls, the ability to control the deflection of the turning bars is a marked advantage over breast rolls which must be provided with a predetermined fixed crown or fixed shape in a cross machine direction. Because of the limited space available in the machine direction, the application of forces to the turning bars to control their cross machine crown is very difficult.

It is accordingly an object of the present invention to provide an improved support for the wires in a twin wire forming machine where the wires are entering the throat of the former.

A further object of the invention is to provide turning bars for supporting the wires of a twin wire forming machine wherein the wires enter the throat over turning bars and the deflection or curvature of the turning bars in a cross machine direction is controlled to obtain a predetermined crown or shape of the bar in a cross machine direction.

A further object of the invention is to provide an improved mechanism for controlling the shape or curvature of a turning bar supporting a traveling forming wire in a paper machine utilizing the expansion and contraction effects of thermally heated or cooled water on metal parts.

FEATURES OF THE INVENTION

In a twin wire forming machine of the type above described, the forming wires are guided into the throat of the forming section for initial dewatering by being passed over cross machine extending turning bars instead of a breast roll. Either one or more turning bars are employed and means are provided, particularly for a wide machine for controlling the crown or straightness of the turning bars in a cross machine direction. In one form, a cross beam is arranged to support the turning bar and bending forces are applied to the cross beam to obtain the correct curvature of the turning bar in a cross machine direction particularly when the turning bar tends to change curvature due to external temperature effects.

In one preferred arrangement, the beam supporting the turning bar is hollow and is provided with one or more liquid chambers into which heated or cooled water is passed so that a portion of the beam either expands or contracts relative to the other portion and thereby forces are applied to the turning bars to either straighten or to increase or decrease the curvature. Accurate measuring devices are utilized along the length of the turning bar and as a function of these measurements, a correcting bending force is applied such as by changing the temperature of the liquid flowing through the chambers of the supporting beam.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
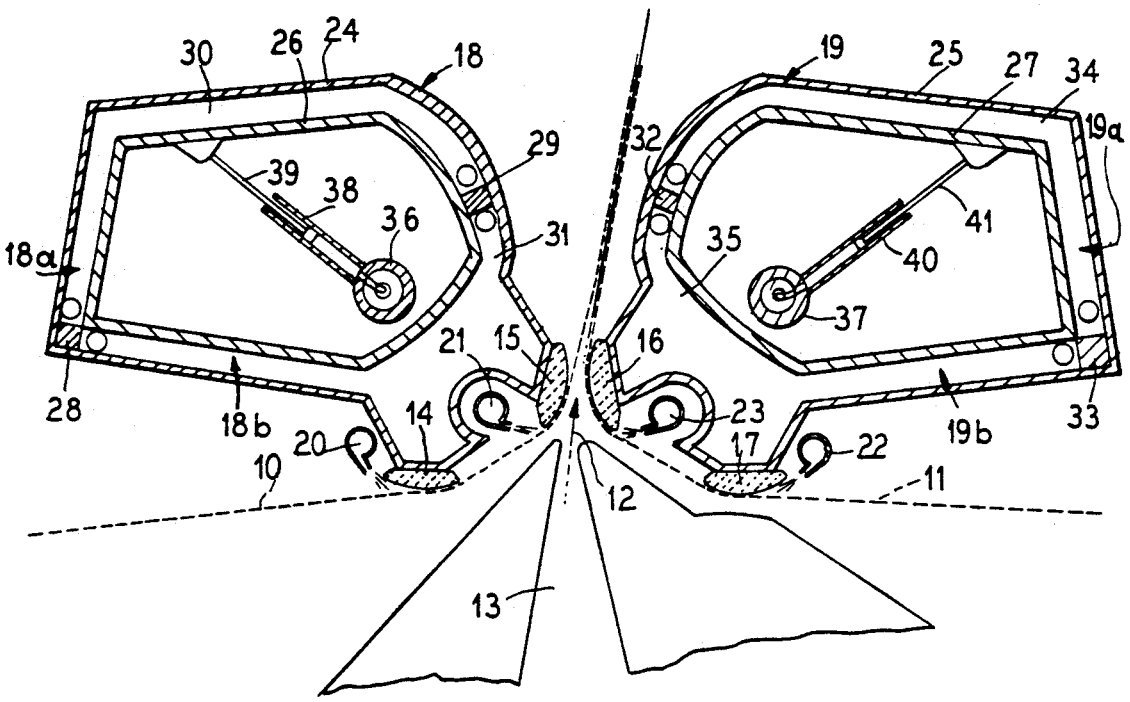
FIG. 1 is a vertical sectional view, shown somewhat schematically, viewing the beginning end of the forming section of a papermaking machine in a cross machine direction.

As illustrated in FIG. 1, twin forming wires 10 and 11 are guided into an initial forming throat as indicated by the arrow 12. Paper machine stock is directed into the throat in a slurry by the slice 13 of a headbox.

For guiding the wires into the throat, turning bars are employed with turning bars 14 and 15 supporting and guiding the wire 10. Turning bars 16 and 17 guide the wire 11 into the throat. As will be observed, these bars permit control of the wire and the bringing of the formation zone of the throat close to the slice requiring less space than supporting breast rolls would require.

The turning bars 14 and 15 are supported on a cross machine beam 18 and the turning bars 16 and 17 are supported on a cross machine beam 19. Each of the beams is provided with means for applying bending forces, or in other words controlling their deflection to thereby control the deflection of the turning bars. If the bars are to be absolutely straight in a cross machine direction, the beams are maintained straight, whereas if a crown is to be placed on the bars to cause a spreading force to be applied to the wires, the beams will cause that crown to curve. Also, if forces and temperature differences will cause the turning bars to be inaccurate in a cross machine direction, the beams will have forces applied thereto to insure that the turning bars have the correct cross machine posture and perhaps even a negative crown may be desired.

In one form, the beam may have mechanical devices to apply bending forces along its length, but in a preferred arrangement2 the bending forces are applied internally by temperature control of the beam along its length. As will be seen from the beam 18, it includes an outer shell 24 and an inner shell 26 with the shells defining a hollow chamber 30 therebetween, the chamber being generally annular in shape.

The beam 19 includes an outer shell 25 and inner shell 27 spaced therefrom to define a hollow annular chamber 34 therebetween.

The chambers are divided so that when liquid flows through the chamber, it affects only a portion of the beam to cause an expansion or contraction of the metal thereby generating a bending effect.

As will be seen in FIG. 1, the chamber 30 has barriers 28 and 29 placed therein so that the lower portion of the chamber 31 is isolated from the upper portion.

For the beam 19 shown on the right in FIG. 1, barriers 32 and 33 are placed so that the annular chamber 34 has a lower portion 35.

The upper chamber 30 of the beam 18 is supplied with liquid by a liquid supply line 18*a*. This liquid supply line may take the form of dual lines for the flow of liquid into the chamber 30 and the flow of liquid out so as to bring the chamber 30 to a predetermined temperature.

The other beam 19 also has the upper chamber 34 connected to a liquid supply 19*a* with a similar liquid return so as to maintain the upper portion of the chamber at a predetermined temperature or to change the temperature during operation of the machine.

While in a simplified form only liquid may be supplied to the upper chamber 30, it is also possible to supply liquid to the lower chamber 31 of the beam 18 and to the lower chamber 35 of the beam 19. Liquid of a constant temperature may be supplied to the lower chambers 31 and 35 whereas the liquid to the upper chambers 30 and 34 may be changed in accordance with the amount desired to create a crowning or bending force on the turning bars. Or, conversely, the upper chambers 30 and 34 may be supplied with a liquid at a fixed temperature whereas the liquid supplied to the lower chambers 31 and 35 may be varied to control the bending force on the beam. The lower chamber 31 may be supplied through a line shown schematically at 18*b* and the lower chamber of the beam 19 may be supplied through a lower line shown schematically at 19*b*.

It is also contemplated that the bending force which needs to be applied to the beam can be obtained by a temperature differential between the liquid in the chamber 30 and the chamber 31 so that one chamber may have chilled liquid supplied thereto and the other a heated liquid. On the other hand, both liquids may be heated with a predetermined differential in temperature obtained. The differential in temperature will cause the bending of the beam and hence the bending of the turning bars 14 and 15. For example, if the lower chamber 31 is maintained at a higher temperature than the upper chamber 30, the beam will bend downwardly or cause a crown at the center of the machine. If conversely, the upper chamber 30 is maintained at a higher temperature than the lower chamber 31, then the beam will tend to have a negative crown and to bow upwardly in the center. It is understood that the ends of the beam will be rigidly supported on framework.

In advance of the turning bars 14 and 15, are showers 20 and 21 to help maintain the wire 10 clean. In advance of the turning bars 17 and 16, are showers 22 and 23 to help maintain the wire 11 clean.

It is important that deflection of the beam, which of course measures the deflection of the turning bars, be measured and that the curvature of the beam be controlled as a function of the measurement. In other words, by the measurement of the deflection, the temperature of the fluid directed to the chambers 30 and 31 is controlled as a function of the measurement.

For purposes of measuring, a fixed reference bar 36 is located within the hollow beam 18 and a fixed reference bar 37 is located within the hollow beam 19. These reference bars are supported only at their ends and do not bend with the beam and are structurally independent of the beam along their length.

Figure 2:
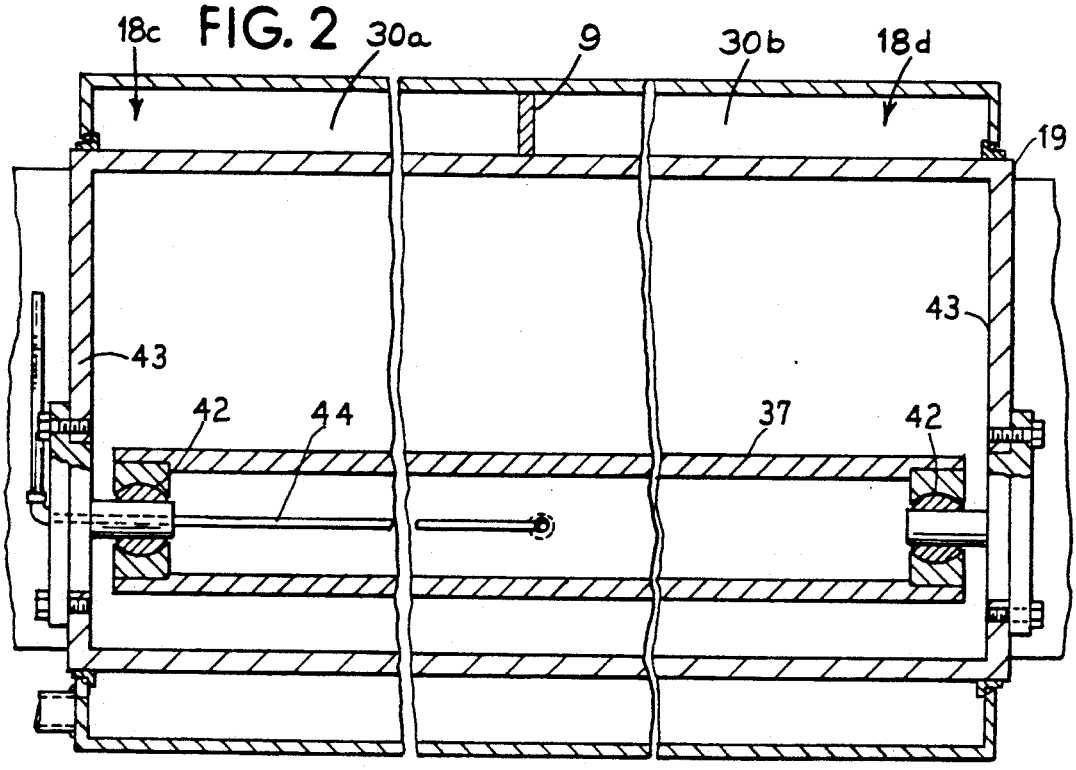
FIG. 2 is a fragmentary sectional view taken through a supporting beam and a portion of the measuring device for supporting a turning bar for a twin wire papermaking machine.

As shown in FIG. 2, the reference bar 37 is supported by ball joints 42 mounted on the end walls 43 of the beam 19. The output of the measuring device is fed through a line 44 externally of the beam, and this output which measures the actual deflection of the beam will be used to control and obtain the desired deflection by controlling the temperature of water or other liquid passed into the beam chambers.

While one continuous outer chamber 30 for the beam 18 and one continuous inner chamber 31 may be used, in certain circumstances plural chambers such as 30*a* and 30*b* divided by wall 9 along the cross machine length of the beam may be employed. By separate water supplies 18*c* and 18*d* these different cross machine chambers and controlling the individual water supplies, different curvatures can be applied along the cross machine length of the turning bars 14 and 15. This will be particularly advantageous in very wide papermaking machines.

Figure 3:
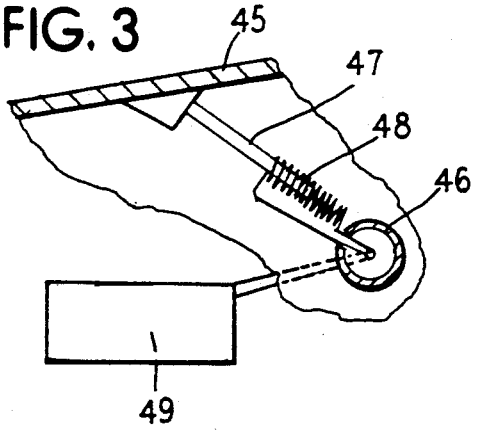
FIG. 3 is a fragmentary sectional view, shown somewhat schematically, of a deflection measuring device.

FIG. 3 illustrates another form of measuring device wherein a fixed reference bar 46 is supported at its ends. A plunger 47 is supported on a beam 45 and with deflection of the beam, the plunger 47 will move relative to the reference bar 46 which carries an electrical coil 48. Movement of the rod 47 within the coil will generate an electrical output to an indicator or control device 49. The control device 49 may be used to automatically control the heater to cool liquid supplied to the chambers of the beam in accordance with the program directed by the machine operator.

Figure 4:
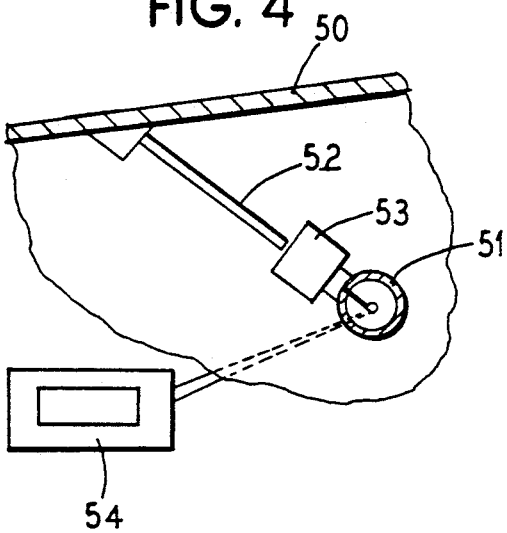
FIG. 4 is a fragmentary sectional view, shown somewhat schematically, of a deflection measuring device.

FIG. 4 illustrates another modified form of measuring device wherein a beam 50 has a reference bar 51 extending therethrough supported on its ends. A rod 52 is attached to the beam and moves relative to a base member 53. The output of the measuring device will indicate the movement or the distance of the rod 52 relative to the measuring device 53 which will be received by a recorder or control 54.

The measurement of deflection is important to the control of the curvature of the support beam. This measurement can be by various known devices either linear or slide-type or magnetic or gap-type, and they function to measure the distance from the beam body to an independently mounted structure which is shown as the reference bar.

The deflection of the turning bars is controlled by the beam and the beam has sufficient strength so that reaction forces of the wire on the turning bars after start-up would not substantially affect the beam. In other words, a position of operating stability is obtained by giving the beam a shape to support the turning bars in the shape desired. The turning bars may be of ceramic material to sustain the wear of the traveling wires with the ceramic material being formed of segmented blades to function as wire supports and wire control and the turning bars are supported independently of the tension control on the wires.

Figure 5:
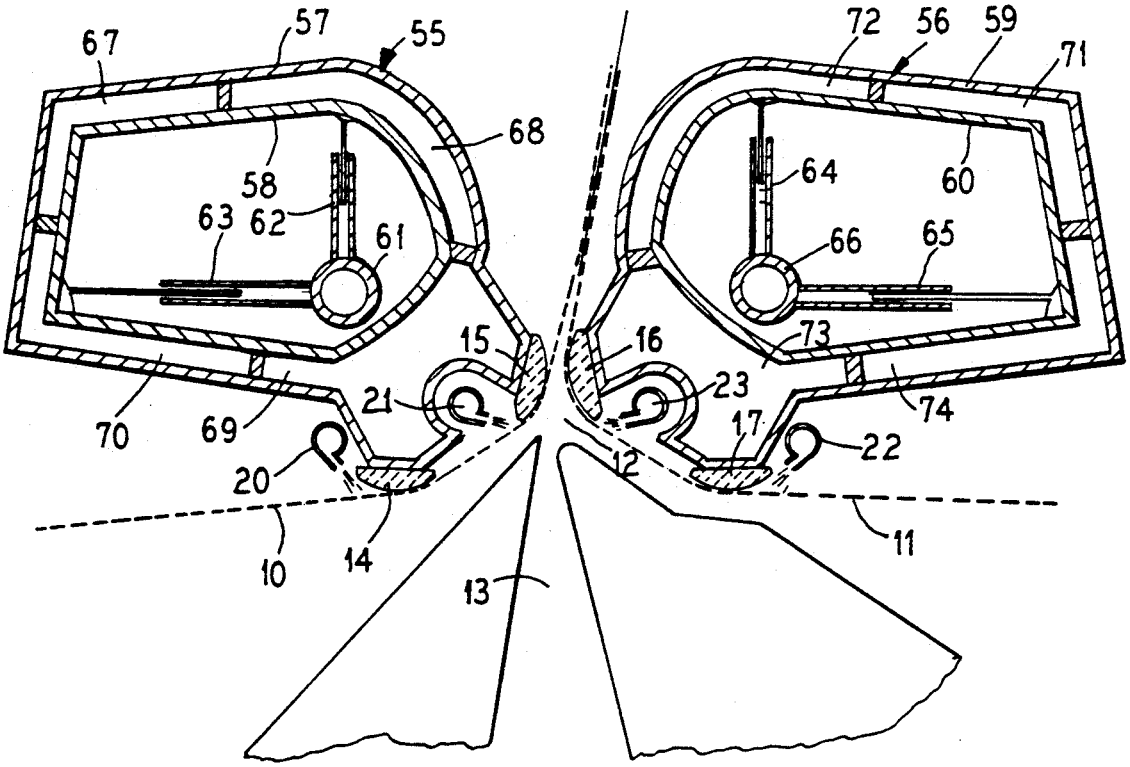
FIG. 5 is a vertical sectional view of another form of cross machine deflection control for turning bars in a twin wire former.

FIG. 5 illustrates another form of support beam for turning bars. In FIG. 5 parts similar to FIG. 1 are numbered similarly with stock flowing from a slice 13 into a throat 12 between traveling forming wires 10 and 11. Turning bars 14 and 15 support the wire 10 at the lead end of the twin wire forming section and turning bars 16 and 17 support the wire 11. Showers 20 and 21 are within the wire 10 and showers 22 and 23 are within the wire 11.

The turning bars are supported on beams 55 and 56. The beams have an outer shell 57 and 59 respectively and an inner shell 58 and 60 to define a generally annular space therebetween. Dividers are positioned in the annular space for the beam 55 so as to form chambers 67, 68, 69 and 70 for the beam 55. The dividers are located in the annular space of the beam 56 to provide chambers 71, 72, 73 and 74. Each of these chambers is provided with a separate thermally controlled liquid supply to control the bending of the beam.

Each of the beams has a reference rod 61 and 66, respectively, mounted at their ends so as to be in a fixed position relative to the bendable beam. Mounted between the rod 61 and the beam 55 is a vertical measuring device 62 and a horizontal measuring device 63. For the beam 56, a vertical measuring device 64 and a horizontal measuring device 65 are mounted between the beam and the reference bar 66. Thus, with the division of the individual chambers as a read-out is provided by the vertical and horizontal measuring devices, water of different temperatures will be admitted to the different chambers to very accurately and positively control the deflection of the beam. Again with wide machines, the different chambers can be divided in a cross machine direction, and the separate chambers be temperature controlled to give different cross machine temperatures and thus obtain isolated control at different cross machine locations.

By very accurate control of the beams with the multiple chambers, this allows shaping the ceramic turning bars for the best wire tension control.

With the arrangement provided, the turning bars can be used for wire spreading control. They also can be used to control the wire tensions across the machine and obtain better control of the forming zone geometry. These will eliminate the need for other spreading devices within the wire run. In the past when lead-in rolls were used for the forming zone, these have had a fixed shape due to cost and design space. With wider machines in twin wire formers, the characteristics of forming fabrics and wire deflections have caused nonuniform fabric tensions. These nonuniform tensions cause drainage differences in the first critical forming area. It is well known to papermakers that it is essential in this initial forming zone where a substantial amount of water is removed, to have uniform drainage and this can be disadvantageously affected by improper wire tensions and disturbances as the slice ejected stock slurry enters the forming area. Past arrangements have attempted to use curved or bowed rolls to spread the fabric, and these rolls are difficult to maintain and doctor causing cleanliness and maintenance problems on the paper machine. By providing thermal jackets on the supporting beam for the turning bars, the segmenting of the thermal jackets into multiple chambers and operating the chambers at different temperatures will deflect the supporting beam to control the shape of the ceramic segments of the turning bars either from zero to a positive crown or even to a negative crown. The deflection, as the machine is loaded and run, is measured and the temperature of the liquid fed into the divided chambers is controlled as a function of the measurement so as to obtain a predetermined controlled cross machine shape to the turning bars While various be used to control the temperature of the support beam, or to apply a force to the support beam, a preferred arrangement because of the accessibility of heating or cooling water, is to utilize individual water chambers.

Thus, it will be seen there has been provided an improved controlled deflection turning bar arrangement which meets the objectives and advantages above set forth and provides a device which can be readily controlled during operation and does not require complicated or expensive equipment or that which requires frequent shut-down and maintenance.

I claim as my invention:

1. A mechanism for forming a paper web from paper stock fibers in a slurry ejected from a slice of a headbox comprising, in combination:

first and second opposed looped forming wires defining therebetween a web forming section dewatering run extending from a lead end;

said lead end forming a converging throat between the wires for the entry of stock slurry from the headbox slice;

first and second beam means disposed in a cross machine direction, each within a corresponding looped forming wire, each of the first and second beams including inner and outer shells defining an annular space therebetween which contains a liquid;

dividing means within the first and second beam means, said dividing means positioned to divide the annular space into at least two chambers extending in the cross machine direction;

a first turning bar within the first wire stationarily mounted on the first beam means at the lead end positioned to turn and guide the first wire into the throat;

a second turning bar inside the second wire stationarily mounted on the second beam means at the lead end positioned to turn and guide the second wire into the throat; and control means for adjustably controlling the temperature of the liquid within each chamber and thereby controlling the deflection of each of the turning bars to control the incoming wires to minimize the disturbance of the paper stock entering the throat.

2. A mechanism for forming a paper web from paper stock fibers in a slurry ejected from the slice of a headbox constructed in accordance with claim 1:

wherein each of said turning bars is supported on a hollow support of the respective beam means; and a fluid supply means connected to each of the chambers for supplying the liquid to each chamber;

3. A mechanism for forming a paper web from paper stock fibers in a slurry ejected from the slice of a headbox constructed in accordance with claim 1:

wherein each of the first and second turning bars includes dual bar sections separated in the direction of wire travel.

4. A mechanism for forming a paper web from paper stock fibers in a slurry ejected from the slice of a headbox constructed in accordance with claim 1:

including measuring devices measuring the cross-direction deflection of the turning bars, said measuring devices connected to the control means so that the travel of the wires thereover can be controlled.

5. In a paper machine headbox assembly, the combination comprising:

a headbox having a slice opening for directing a stream of stock slurry into a forming throat;

a pair of looped forming wires positioned to provide the forming throat receiving the stock from the headbox slice;

beam means including a turning bar stationarily mounted on the beam means inside each of the wires for turning and guiding the wires into the throat , said beam means including a stationary support beam extending in a cross machine direction for each of the turning bars;

each said support beam including inner and outer shells defining annular chambers with spaced cross machine separations therebetween;

and deflection control means for each of the turning bars for controlling bar defection to minimize stock disturbance due to improper wire path at the throat, the deflection control means including thermal control means for controlling the temperature of selected portion of the turning bar in a cross machine direction for varying the deflection along the cross machine length of the bar, said thermal control means comprising a temperature control liquid supply for each of said chambers.

6. In a paper machine headbox assembly constructed in accordance with claim 5, the combination comprising:

deflection measuring means within the annular chambers for measuring the deflection of the bars.

7. A mechanism for forming a paper web from paper stock fibers in a slurry ejected from a slice of a headbox comprising, in combination:

a first dewatering means including first and second looped forming wires forming a part of a dewatering run and extending from a lead end having a converging dewatering throat defined by the first and second forming wires;

a stationary turning bar inside of at least one of the looped forming wires at the lead end positioned to turn and guide the wire into the throat;

a support for the turning bar having inner and outer shells defining an annular chamber, said annular chamber containing barrier means to separate the annular chamber into an upper portion and a lower portion, at least said upper portion containing a fluid, means for controlling temperature of the fluid in the upper portion of said chamber for controlling the curvature of the turning bar;

means for measuring the deflection of the turning bar;

and means for directing the fluid into the upper portion of said chamber as a function of the deflection of the turning bar for controlling cross machine turning bar deflection and for compensating the variations in curvature due to the temperature of the turning bar.

* * * * *